US006762540B2

(12) United States Patent
Schaefer et al.

(10) Patent No.: US 6,762,540 B2
(45) Date of Patent: Jul. 13, 2004

(54) ONE-PIECE TAB ASSEMBLY FOR A CATHODE CUP OF AN X-RAY IMAGING MACHINE

(75) Inventors: Thomas D. Schaefer, Milwaukee, WI (US); J. Scott Price, Wauwatosa, WI (US); Sergio Lemaitre, Whitefish Bay, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 56 days.

(21) Appl. No.: 10/065,508

(22) Filed: Oct. 25, 2002

(65) Prior Publication Data

US 2004/0081282 A1 Apr. 29, 2004

(51) Int. Cl.[7] ..... H01J 1/46
(52) U.S. Cl. ..... 313/302; 313/270; 313/292
(58) Field of Search ..... 313/446, 238, 313/270, 292, 302

*Primary Examiner*—Vip Patel
(74) *Attorney, Agent, or Firm*—Peter J. Vogel

(57) ABSTRACT

A cathode assembly (43) for a computed tomography scanning system (10) is provided. The cathode assembly (43) includes a one-piece tab assembly (52) for simple and relatively quick installation on a cathode cup (44). In one embodiment, the one-piece tab assembly (52) has two rail portions (56) extending substantially across its length. These rail portions (56) are intended for insertion into channels (50) formed within the cathode cup (44) and for properly locating the one-piece tab assembly (52) in a desired position relative to the filament (46). The assembly (52) further includes two tab portions (58, 58") located on opposing ends of the rail portions (56). The tab portions (58, 58") each include a main body portion (62) and a flap portion (54) extending from the main body portion (62). The main body portion (62) extends between the two rail portions (56) and has a mounting surface for attaching the one-piece tab assembly (52) to the cathode cup (44). The flap portions (54) extend substantially perpendicular from the main body portions (62) and direct the electron beam emitted by the filament (46).

20 Claims, 6 Drawing Sheets

ONE-PIECE TAB ASSEMBLY FOR A CATHODE CUP OF AN X-RAY IMAGING MACHINE

BACKGROUND OF INVENTION

The present invention relates generally to X-ray imaging machines, and particularly to X-ray imaging machines that include dihedral cathode cups with cathode tabs for producing desired focal spot length profile.

A traditional X-ray imaging system employs an X-ray source and a detector array for producing an internal image of an object. The X-ray source generates X-rays which pass through the object. This object absorbs a portion of the X-rays as the X-rays are transmitted therethrough. As a result, the transmitted X-rays vary in intensity. The detector array receives and measures the resultant X-ray flux so as to generate the electrical signals necessary for constructing an internal image of the object.

Computed tomography (CT) imaging systems typically include a gantry that rotates at various speeds in order to create a 360° image. The gantry contains a CT tube assembly that generates X-rays across a vacuum gap between a cathode and an anode. In order to generate the X-rays, a large voltage potential of approximately 120–140 kV is created across the vacuum gap allowing electrons, in the form of an electron beam, to be emitted from the cathode to be incident on the target of the anode. In releasing the electrons, a filament contained within the cathode is heated to incandescence by passing an electric current therein. The electrons are accelerated by the electric field and impinge on the target at a focal spot, whereby they are abruptly slowed down and directed at an impingement angle $\alpha$ of approximately 90° so as to emit X-rays through a CT tube window.

The filament or electron source typically is a coiled tungsten wire that is heated to temperatures approaching 2600° C. The electrons are accelerated by an electric field imposed between the cathode and the anode. The anode, in a high power X-ray tube designed for current CT devices, is a target having a target face that rotates at angular velocities of approximately 120 Hz or greater. This target may be comprised of molybdenum, graphite, and various other materials.

Cathode tabs typically are positioned adjacent to the filament in order to focus the X-ray flux or electron beam and produce a uniform focal spot length profile. Ordinarily, two cathode tabs are located on opposite ends of the filament. Existing tabs are L-shaped brackets that surround the filament. One portion of the bracket typically is fastened to the cathode cup while the other portion is utilized for directing the electron beam.

A drawback of existing cathode tabs is that meticulous alignment of these tabs on the cathode cup is usually necessary for producing the desired focal spot length profile. Ordinarily, CT scanner manufacturers carefully fasten each tab to the cathode cup in a specific predetermined position. This position is usually based on precise distances from the filament, as well as the distances between the tabs themselves. In this regard, installation of the separate tabs results in a labor intensive, time-consuming procedure.

Therefore, a need exists to provide a cathode assembly having a structure that simplifies integration of cathode tabs within the cathode cup thereby decreasing installation time and costs associated therewith.

SUMMARY OF INVENTION

The present invention provides a cathode assembly for an X-ray imaging machine. The cathode assembly includes a one-piece tab assembly for simple and relatively quick installation on a cathode cup. In one embodiment, the one-piece tab assembly has at least two rail portions extending substantially across its length. These rail portions are intended for insertion into channels formed within the cathode cup and for properly locating the one-piece tab assembly in a desired axial position on the cathode cup. The cathode assembly further includes a first tab portion and a second tab portion located on opposite ends of the rail portions. The first tab portion and the second tab portion each include a main body portion and a flap portion. The main body portion extends between the two rails and includes a mounting surface for attaching the one-piece tab assembly to the cathode cup. The flap portions extend substantially perpendicular from the main body portions and direct the electron beam emitted by the filament.

One advantage of the present invention is that a one-piece tab assembly is provided with at least two rail portions integrated therein for insertion into channels of a cathode cup and properly locating the one-piece tab assembly on the cathode cup.

Another advantage of the present invention is that a one-piece tab assembly is provided that may be properly located on the cathode cup by merely adjusting the position of the one-piece tab assembly along one axis of movement.

Still another advantage of the present invention is that a one-piece tab assembly is provided with a first tab portion and a second tab portion located at a fixed distance from each other so as to eliminate the need for adjusting the tabs relative to each other.

Yet another advantage of the present invention is that a one-piece tab assembly is provided with a main body portion for mounting the one-piece tab assembly to a cathode cup.

Other advantages of the present invention will become apparent upon reading the following detailed description and appended claims, and upon reference to the accompanying drawings.

BRIEF DESCRIPTION OF DRAWINGS

For a more complete understanding of this invention, reference should now be had to the embodiments illustrated in greater detail in the accompanying drawings and described below by way of examples of the invention. In the drawings.

DETAILED DESCRIPTION

The present invention is illustrated with respect to a Computed Tomography (CT) scanning system 10 particularly suited to the medical field. The present invention is, however, applicable to various other scanning systems utilized in a variety of other environments, as will be understood by one skilled in the art.

Figure 1:
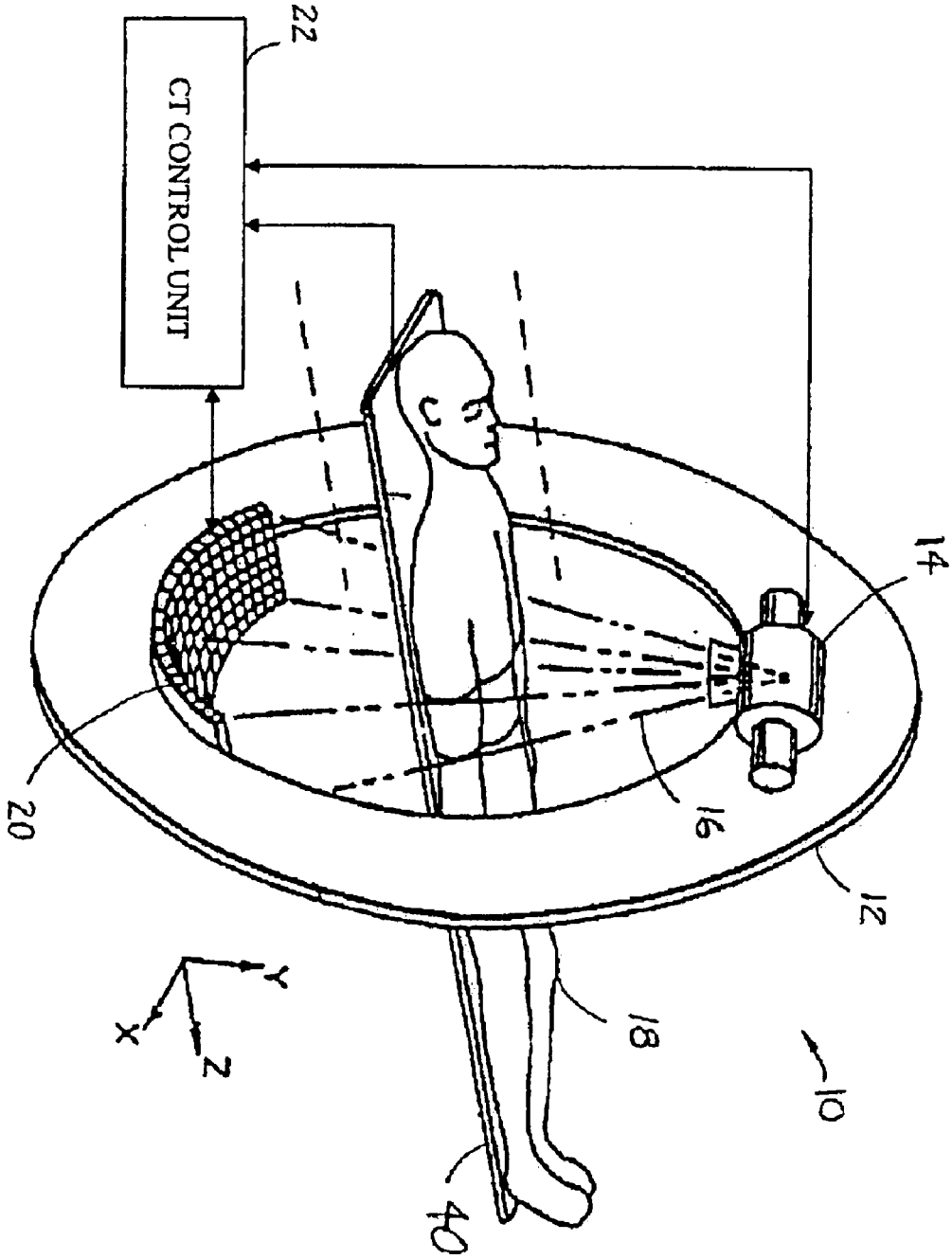
FIG. 1 is a perspective view of computed tomography scanning system according to one embodiment of the present invention.
Figure 2:
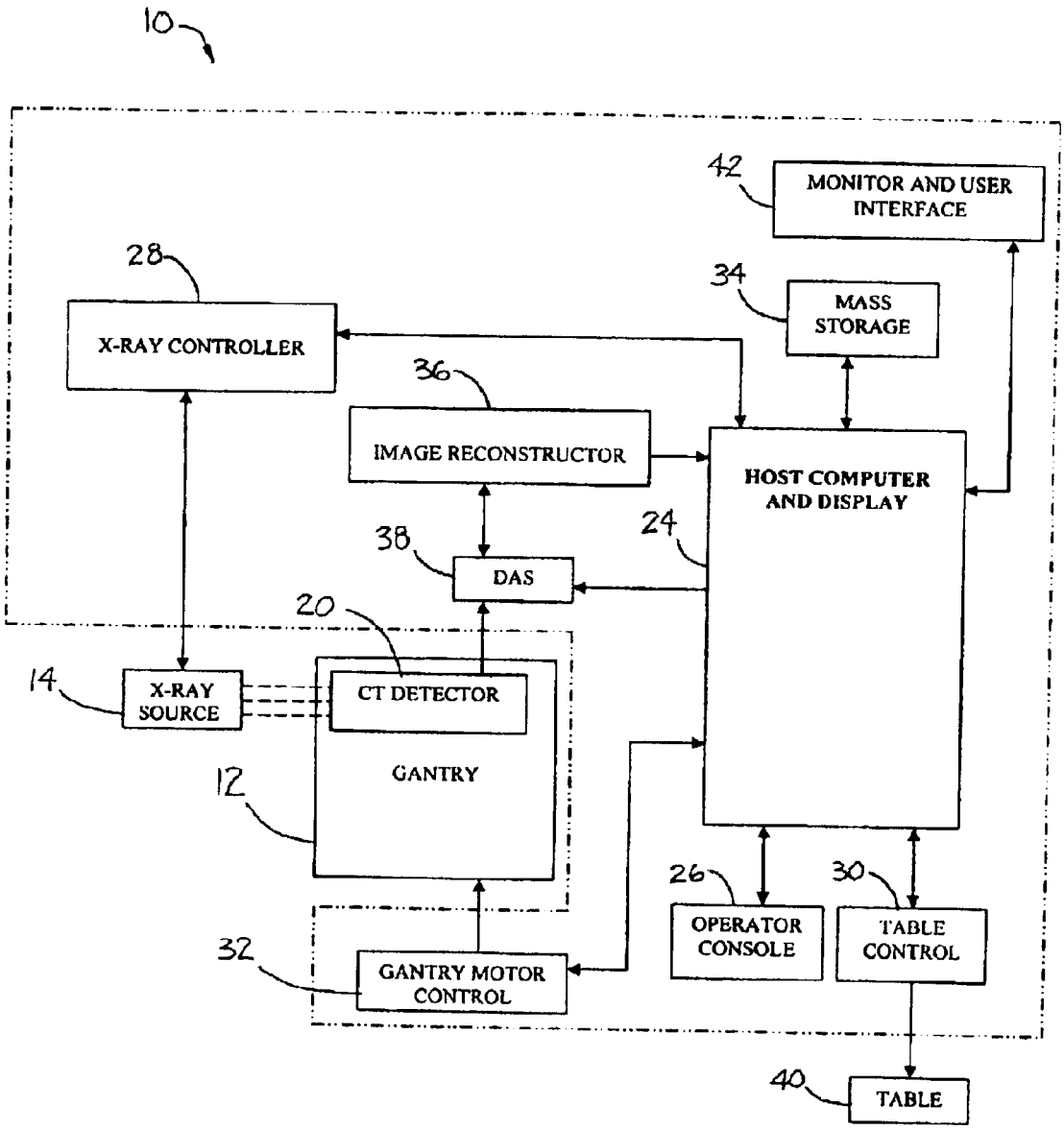
FIG. 2 is a schematic diagram representing computed tomography scanning system according to one embodiment of the present invention.

Referring to FIGS. 1 and 2, a CT scanning system 10 including a gantry 12, in accordance with one embodiment of the present invention, is illustrated. An X-ray source 14, coupled to the gantry 12, generates an X-ray flux 16, which passes through an object 18 (e.g. a patient). The system 10 further includes a X-ray detector 20, coupled to the gantry 12, which generates a detector signal in response to the X-ray flux 16.

A CT control unit 22, including a host computer and display 24 and various other widely known CT control and display components, receives the detector signal and responds by generating an image signal. The CT control unit 22 also includes, for example, an operator console 26, an X-ray controller 28, a table controller 30, a gantry motor controller 32, a mass storage unit 34, an image reconstructor 36 and a data acquisition system 38, all of which will be discussed later.

The gantry 12 is a ring shaped platform that rotates around the scanned object 18 in response to signals from the gantry motor controller 32, as will be understood by one skilled in the art. Ideally, the X-ray source 14 and CT (multi-slice or single) detector 20 are coupled thereto.

Figure 3A:
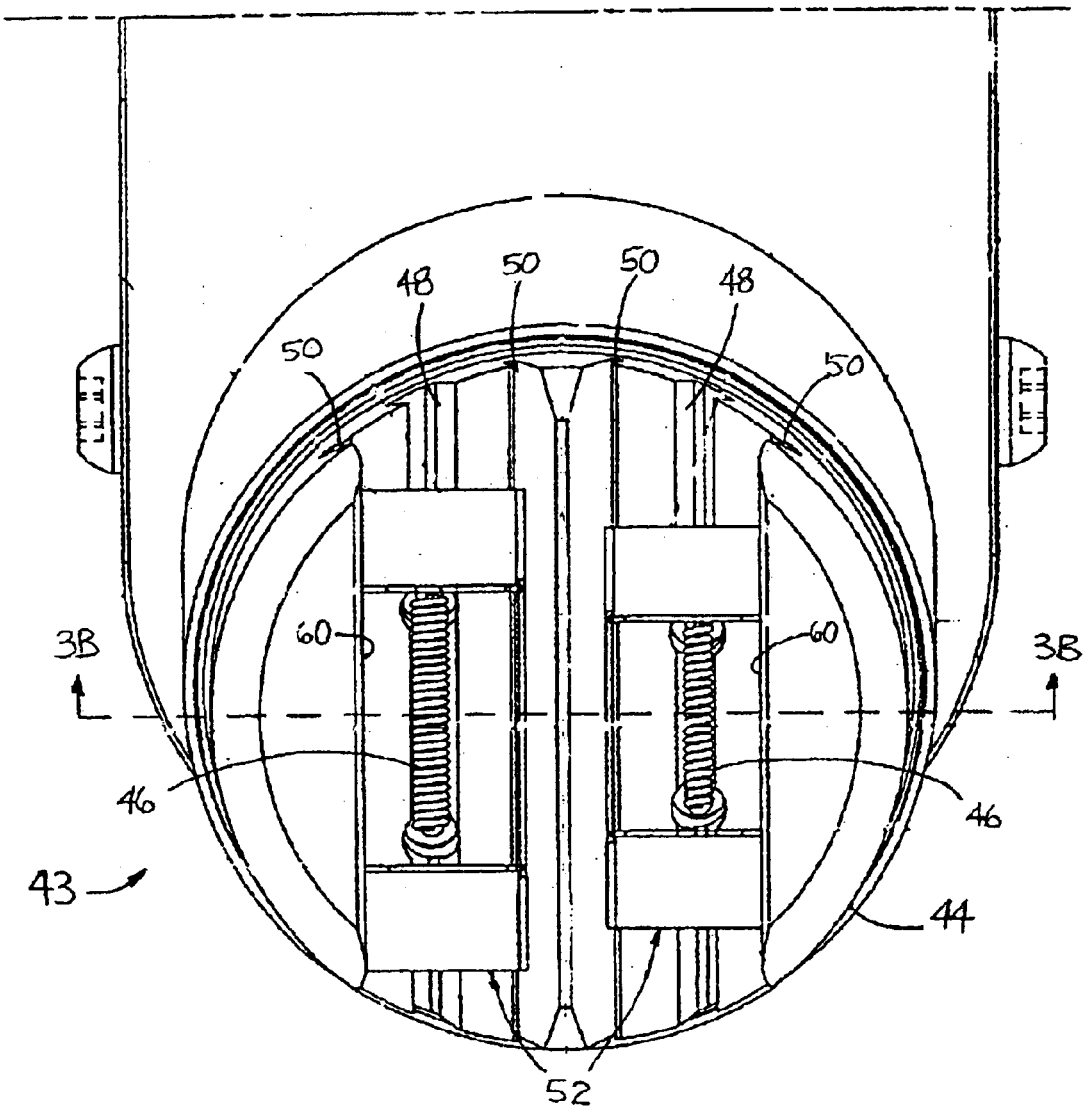
FIG. 3A is a top elevation view of a cathode assembly having a dihedral cathode cup and a one-piece tab assembly according to one embodiment of the present invention
Figure 3B:
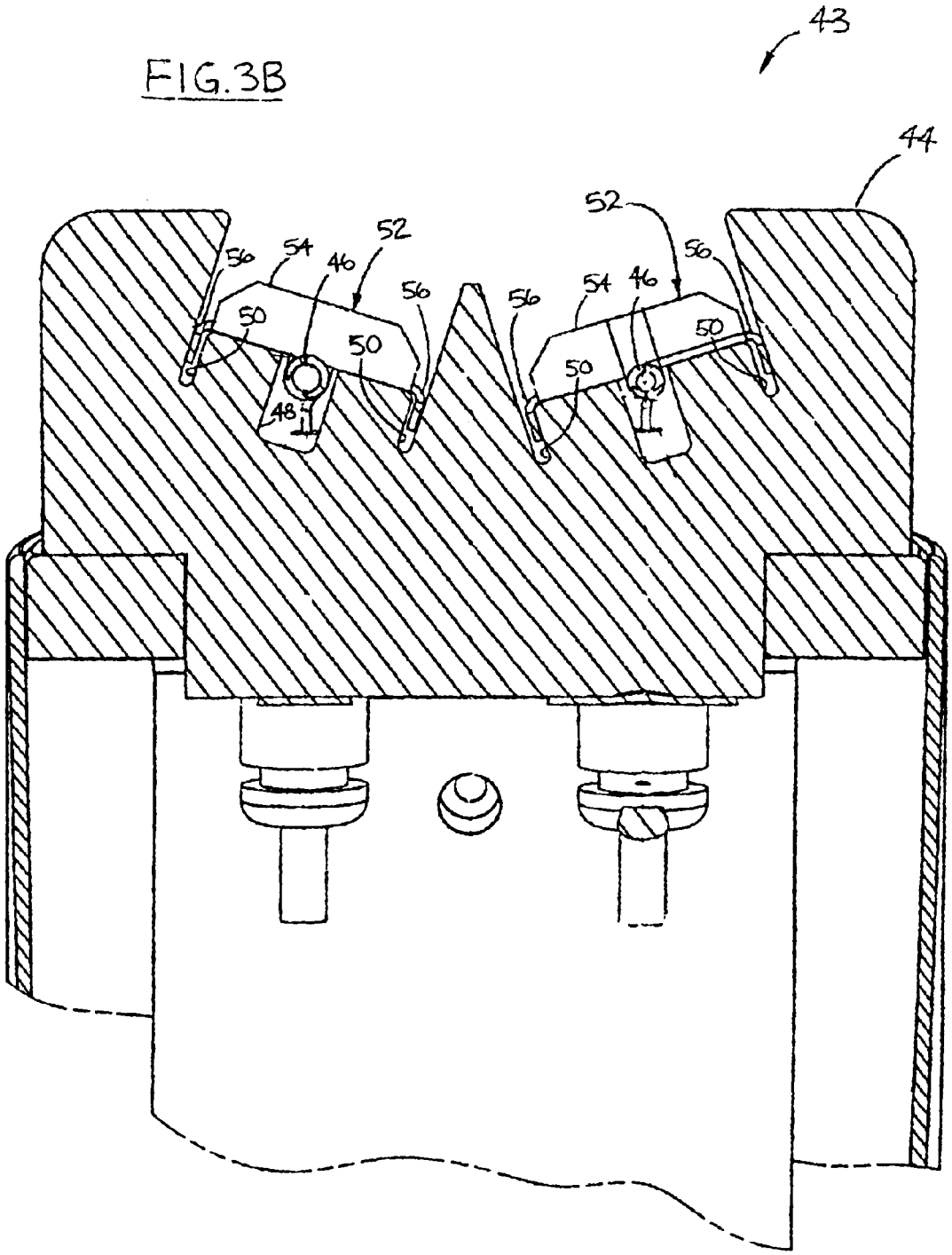
FIG. 3B is a cross-sectional view of the cathode assembly illustrated in FIG. 3A, taken along line 3B—3B.

In one embodiment of the invention, the X-ray source 14 is an X-ray tube with a cathode cup assembly 43 (as shown in FIG. 3A and 3B) integrated therein. The cathode cup assembly 43 includes a dihedral cathode cup 44 and two one-piece tab assemblies 52 for forming a desired profile of the X-ray flux 16 or electron beam emitted from the cup 44. The cathode cup assembly 43 is described in detail in the explanations for FIG. 3A, 3B, and 4.

The X-ray source 14 is activated by either a host computer 24 or an X-ray controller 28, as will be understood by one skilled in the art. The X-ray source 14 sends the X-ray flux 16 through an object 18 on a moveable table 40 controlled by a table control device 30 acting in response to signals from the host computer 24.

X-ray flux 16 from the X-ray source 14 passes through the patient and impinges on the X-ray detector 20. The signal passes directly to the host computer and display 24, where the signal is converted to a gray level corresponding to the attenuation of the X-ray photon through the patient, for the final CT image.

The X-ray detector 20 is typically located opposite the X-ray source 14 to receive the X-ray flux 16 generated therefrom and includes several modules. Each module shares information with other modules corresponding to a number of slices.

Modern X-ray detectors typically have N slices in the table motion direction, where N is 4,8,16, or other number depending on system requirements. These multi-slice configurations extend area of coverage and offer reduced scan times and increased resolution.

The present invention is illustrated with respect to CT, however it is alternately used for any type of X-ray system using detectors including mammography, vascular X-ray imaging, bone scanning, etc. Further embodiments include non-medical applications such as weld inspection, metal inspection. Essentially, anything that could use a digital X-ray detector or film to make 1, 2 or 3 dimensional images.

The host computer 24 receives the detector signal. The host computer 24 also activates the X-ray source 14, however, alternate embodiments include independent activation means for the X-ray source. The present invention includes an operator console 26 for control by technicians, as will be understood by one skilled in the art.

Data is acquired and processed, and a CT image, for example, is presented to a radiology technician through the monitor and user interface 42 while the scan is occurring. The host computer 24 needs only read the module signals and update the display at the appropriate locations through, for example, an image reconstructor 36 and data acquisition system (DAS) 38. The host computer 24 alternately stores image data in a mass storage unit 34 for future reference.

Referring now to FIGS. 3A and 3B, there is shown a cathode cup assembly 43 according to one embodiment of the present invention. The cathode cup assembly 43 includes a dihedral cathode cup 44 and two one-piece tab assemblies 52 for attachment to the cup 44. The cup 44 has two filaments 46 contained therein for producing an X-ray flux. Specifically, the cup 44 has a recess 48 integrated therein into which the filament 46 is positioned. In addition, the cup 44 includes a pair of channels 50 integrated therein adjacent to each recess 48. Each pair of channels so is intended to receive portions of the one-piece tab assembly 52 so as to locate the assembly 52 in a desired position relative to the filament 46. This desired position allows flap portions 54 of the assembly 52 to focus the electrons emitted from the filament 46.

Figure 4:
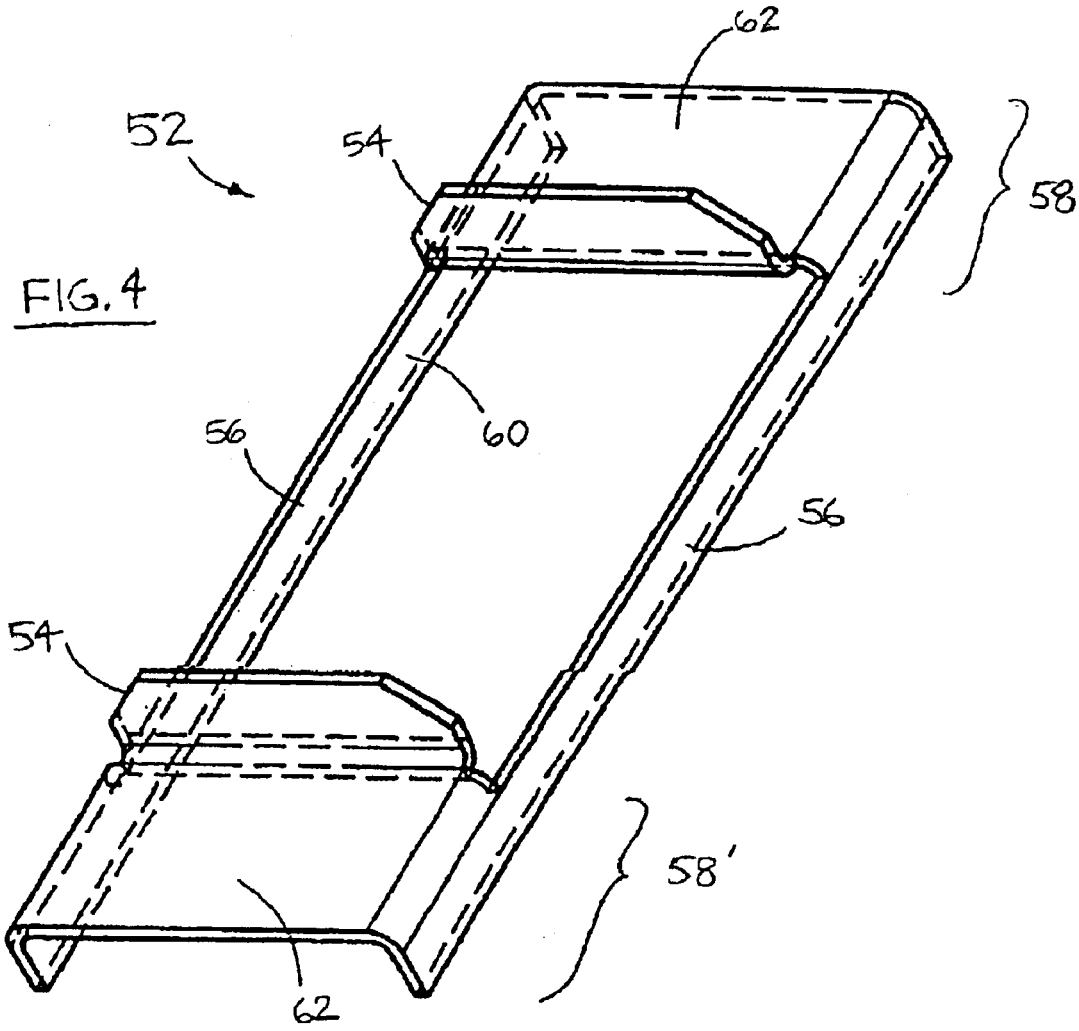
FIG. 4 is a perspective view of a one-piece tab assembly for attachment to a dihedral cathode cup according to one embodiment of the present invention.

In particular, as best shown in FIG. 4, each one-piece tab assembly 52 includes a pair of rail portions 56 which are integral parts of the one-piece tab assembly 52 and extend substantially across the length of the one-piece tab assembly 52. These rail portions 56 are intended for insertion into the channels 50 of the cup 44 for the purpose of locating the assembly 52 in a desired axial position relative to the filament 46. For example, the rail portions 56 may position surfaces of the flap portions 54 perpendicular to a longitudinal axis of the filament 46. These rail portions 56 may also position the flap portions 54 such that each filament 46 is centered on the flap portions 54. The one-piece tab assembly may be comprised of nickel, tantalum, niobium, or various other suitable materials.

A first tab portion 58 and a second tab portion 58" are also integral parts of the one-piece tab assembly 52. These tab portions 58, 58" are integrated within opposing ends of the rail portions 56. These tab portions 58, 58" and the rail portions 56 define a central filament opening 60 for permitting the passage of electrons emitted by the filament 46. Furthermore, the first and second tab portions 58, 58" are fixed on the rail portions 56 at a predetermined length relative to each other. As known by one skilled in the art, fixing the distance between the tab portions 58, 58" is beneficial because it eliminates the need for adjusting the position of conventional tabs relative to each other.

Each tab portion 58, 58" includes a main body portion 62 and a flap portion 54, as introduced above, extending from the main body portion 62. The main body portion 62 and the flap portion 62 are also integral parts of the one-piece tab assembly 52. The main body portions 62 contact the dihedral cup 44 and include mounting surfaces for attachment to the dihedral cup 44. These surfaces may be welded to the cup 44 or otherwise fastened to the cup 44 by various suitable fastening methods. Placing the flap portions 54 in the desired position causes the flap portion 54 to form a desired focal spot length profile from the X-ray flux 16.

Each flap portion 54 extends from the main body portion 62 in a manner that allows the flap portions 54 to focus the X-ray flux to the desired profile. In one embodiment, the flap portions 54 extend perpendicularly from the main body portion 62 so as to likewise position the flap portions 54 in planes that are perpendicular to the rail portions 56. Alternatively, these flap portions 54 extend from the main body portions 62 by a variety of other angles for providing the desired profile. Prior to attachment of the main body portions 62 to the cup 44, the entire one-piece tab assembly 52 may be slid along its rail portions 56 within the channels 50 so as to locate the flap portions 54 in a desired position relative to the filament 46.

Figure 5:
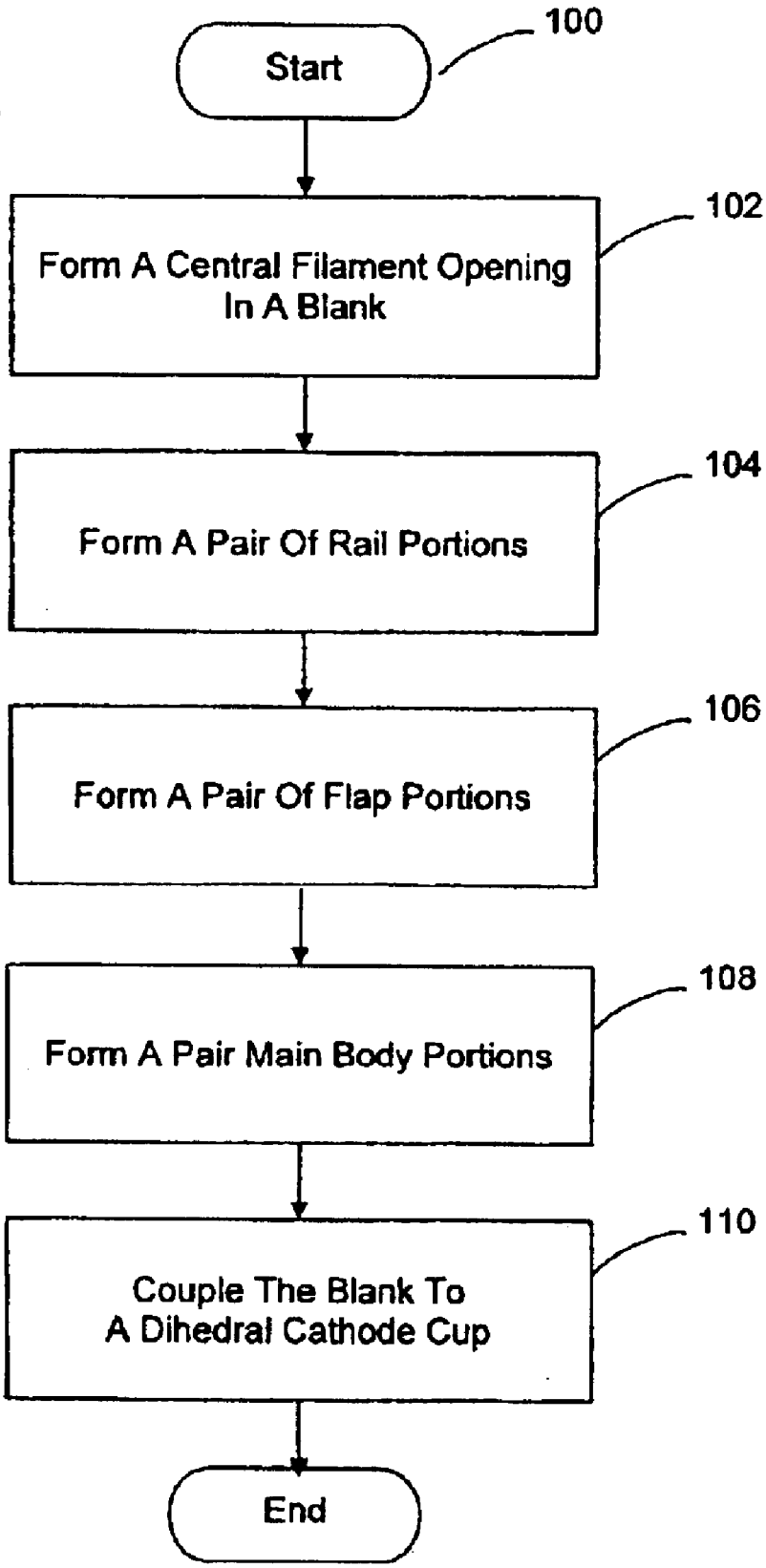
FIG. 5 is a logic flow diagram illustrating a method for manufacturing a one-piece tab assembly for attachment to a dihedral cathode cup according to one embodiment of the present invention.

Referring now to FIG. 5, there is shown a logic flow diagram illustrating a method for manufacturing a one-piece tab assembly 52, in accordance with one embodiment of the invention. The method commences at step 100 and then immediately proceeds to step 102.

In step 102, a central filament opening 60 is formed within a blank. This step is accomplished by utilizing a stamping press machine or other suitable forming manufacturing systems to modify a sheet metal or other suitable blanks. For example, the stamping press machine may punch a hole through the blank so as to form the central filament opening 60. The sequence then proceeds to step 104.

In step 104, at least two rail portions 56 are formed. These rail portions 56 extend from the blank and are intended for insertion into channels 50 formed within a dihedral cathode cup 44. Moreover, these rail portions 56 locate the one-piece tab assembly along a desired axial position of the dihedral cup. The rail portions 56 may extend perpendicularly from the blank or by other angles as desired. Then, the sequence proceeds to step 106.

In step 106, at least two flap portions 54 are formed. These flap portions 54 are intended to focus an X-ray flux 16 emitted from the dihedral cup 44. Focusing the X-ray flux 16 to a desired focal spot length profile requires that the flap portions 54 extend from the blank at a predetermined direction and that the flap portions 54 are located at a predetermined position from the filament 46. For instance, the flap portions 54 may extend perpendicularly from the blank in a direction opposite to the direction, which the rail portions 56 extend. However, these flap portions 54 may extend from the blank in various other directions as desired. Then, the sequence proceeds to step 108.

In step 108, at least two main body portions 62 are formed. This step may be accomplished by die cutting the blank from the sheet metal that comprises the blank. However, the main body portions 62 may be formed by various other suitable manufacturing methods. The sequence the proceeds to step 110.

In step 110, the blank is coupled to a cathode cup 44. This step is accomplished by inserting the rail portions 56 into channels 50 formed within the cup 44. The blank is then positioned along the axis of the channels 50 so as to center the filament 46 in the center filament opening 60. In this respect, the flap portions 54 are located in a desired position relative to the filament 46. Once the blank is placed in the desired position, the main body portions 62 are coupled to the cup 44 by a welding attachment or other suitable fastening methods.

While particular embodiments of the present invention have been shown and described, numerous variations and alternate embodiments will occur to those skilled in the art. Accordingly, it is intended that the invention be limited only in terms of the appended claim.

What is claimed is:

1. A one-piece tab assembly for attachment to a cathode cup of an X-ray imaging machine and surrounding a filament integrated within the cathode cup, the one-piece tab assembly comprising:

at least two rail portions extending substantially across the length of the one-piece tab assembly;

a first tab portion extending between said at least two rail portions; and a second tab portion extending between said at least two rail portions;

wherein said first tab portion and said second tab portion each include:

a main body portion extending between said at least two rail portions, said main body portion intended to provide a mounting surface for attachment to said cathode cup; and a flap portion extending from said main body portion, said flap portion for directing an electron beam emitted from said filament.

2. The one-piece tab assembly of claim 1 wherein said first tab portion and said second tab portion are located on opposing ends of said at least two rail portions.

3. The one-piece tab assembly of claim 2 wherein said at least two rails, said first tab, and said second tab define a central filament opening for permitting said electron beam to pass therethrough.

4. The one-piece tab assembly of claim 1 wherein said flap portion is positioned perpendicular to said at least two rail portions so as to locate said flap portion in a desired position relative to said filament.

5. The one-piece tab assembly of claim 1 wherein said flap portion includes at least two chamfered corners.

6. The one-piece tab assembly of claim 1 wherein the cathode tab assembly is comprised of a material selected from the group consisting of a molybdenum material, a nickel material, a tantalum material, a niobium material, and a hardened steel material.

7. The one-piece tab assembly of claim 1 wherein the cathode tab assembly is attached to the cathode cup by at least one of a weld attachment, a rivet attachment, and a screw fastener attachment.

8. A cathode assembly for an X-ray imaging machine, comprising:

a cathode cup having at least one filament recess for receiving at least one filament therein, said cathode cup further including at least two channels;

at least one one-piece tab assembly having at least two rail portions extending therefrom, said at least two rail portions extending substantially across the length of said at least one one-piece tab assembly, said at least two rail portions intended for insertion into said at least two channels and locating said at least one one-piece tab assembly in a desired position on said cathode cup.

9. The cathode assembly of claim 8 wherein said at least one one-piece tab assembly further includes a first tab and a second tab both extending between said at least two rail portions.

10. The cathode assembly of claim 9 wherein said first tab and said second tab each include a main body portion extending between said at least two rail portions, said main body portion intended to provide a mounting surface for attachment to said cathode cup.

11. The cathode assembly of claim 10 wherein said first tab and said second tab each include a flap portion extending from said main body portion, said flap portion for directing an electron beam emitted from said at least one filament.

12. The cathode assembly of claim 11 wherein said at least two rail portions, said first tab, and said second tab define a central filament opening for permitting an electron beam to pass therethrough.

13. The one-piece tab assembly of claim 11 wherein said flap portion is positioned perpendicular to said at least two rail portions so as to locate said flap portion in a desired position relative to said filament.

14. The one-piece tab assembly of claim 11 wherein said flap portion includes at least two chamfered corners.

15. The one-piece tab assembly of claim 8 wherein said at least one cathode tab assembly is comprised of a material selected from the group consisting of a molybdenum material, a nickel material, a tantalum material, a niobium material, and a hardened steel material.

16. The one-piece tab assembly of claim 8 wherein said at least one cathode tab assembly is attached to said cathode cup by at least one of a weld attachment, a rivet attachment, and a screw fastener attachment.

17. A method for manufacturing a cathode assembly comprising:

forming a central filament opening in a blank;

forming at least two rail portions extending from said blank;

forming at least two flap portions from said blank;

forming at least two main body portions; and coupling said blank to a cathode cup.

18. The method of claim 17 wherein coupling said blank to said cathode cup comprises inserting said at least two rail portions into at least two channels formed within said cathode cup.

19. The method of claim 17 wherein said coupling said blank to said die comprises attaching at least two main body portions of said blank to said cathode cup.

20. The method of claim 19 wherein said coupling said at least two main body portions to said cathode cup comprises welding said at least two main body portions to said cathode cup.

* * * * *